US005490872A

United States Patent [19]

Friswell et al.

[11] Patent Number: 5,490,872

[45] Date of Patent: Feb. 13, 1996

[54] ACID EXTRACTABLE PETROLEUM FUEL MARKERS

[75] Inventors: Michael R. Friswell, Wayne, N.J.; Michael J. Hallisy, Woodstock, Ill.; Michael P. Hinton, Neshanic Station, N.J.

[73] Assignee: Morton International, Inc., Chicago, Ill.

[21] Appl. No.: 234,201

[22] Filed: Apr. 28, 1994

[51] Int. Cl.[6] ..... C10L 1/22

[52] U.S. Cl. ..... 44/328; 44/429; 44/430; 44/432

[58] Field of Search ..... 44/328, 429, 430, 44/432

[56] References Cited

U.S. PATENT DOCUMENTS

| | | | |
|---|---|---|---|
| 1,871,947 | 8/1932 | Bonhote | 534/859 |
| 1,963,133 | 6/1934 | Jordan et al. | 260/97 |
| 2,030,214 | 2/1936 | Knight | 260/81 |
| 2,069,158 | 1/1937 | Schnitzspahn et al. | 260/84 |
| 2,132,872 | 10/1938 | McNally et al. | 8/50 |
| 2,173,417 | 9/1939 | Huber | 260/198 |
| 2,196,984 | 4/1940 | Ellis et al. | 8/48 |
| 2,218,247 | 10/1940 | McNally et al. | 8/50 |
| 2,689,171 | 9/1954 | Hager et al. | 23/230 |
| 2,908,679 | 10/1959 | Kracker et al. | 260/188 |
| 2,925,333 | 2/1960 | Thompson | 44/59 |
| 3,476,500 | 11/1969 | Litke | 8/93 |
| 3,507,903 | 4/1970 | Gottschlich et al. | 260/465 |
| 3,534,016 | 10/1970 | Lange | 260/207.1 |
| 3,734,857 | 5/1973 | Saronno et al. | 252/51.5 |
| 3,844,781 | 10/1974 | Tsuchiya et al. | 96/1.5 |
| 4,011,209 | 3/1977 | De Feo et al. | 260/207.5 |
| 4,764,290 | 8/1988 | Currey | 252/11 |
| 5,156,653 | 10/1992 | Friswell et al. | 44/328 |
| 5,205,840 | 4/1993 | Friswell et al. | 44/428 |
| 5,266,227 | 11/1993 | Reichelt et al. | 252/51.5 R |

FOREIGN PATENT DOCUMENTS

| | | |
|---|---|---|
| 412164 | 9/1932 | European Pat. Off. . |
| 1243141 | 8/1971 | European Pat. Off. . |
| 499845 | 8/1992 | European Pat. Off. . |
| 4120363 | 7/1992 | Germany . |
| 4105603 | 8/1992 | Germany . |
| 4832096 | 12/1968 | Japan . |
| 4812046 | 10/1969 | Japan . |
| 1488898 | 10/1977 | United Kingdom . |

*Primary Examiner*—Prince Willis, Jr.
*Assistant Examiner*—Cephia D. Toomer
*Attorney, Agent, or Firm*—Wayne E. Nacker; Gerald K. White

[57] ABSTRACT

Petroleum fuels are tagged with markers having the formula:

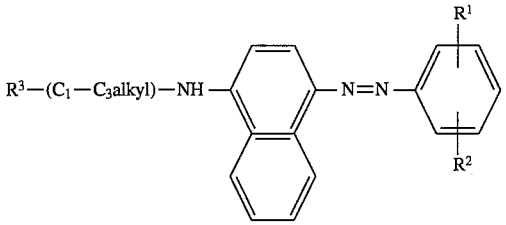

where $R^1$ and $R^2$ are selected from H, methyl, ethyl, methoxy, halogen, cyano and nitro and $R^3$ is selected from methyl, methoxy methoxyethoxy and morpholino.

3 Claims, No Drawings

ACID EXTRACTABLE PETROLEUM FUEL MARKERS

The present invention is directed to the tagging of petroleum fuels with silent markers and to detection of such markers in petroleum fuels.

BACKGROUND OF THE INVENTION

It is known to tag petroleum fuels, such as gasoline, diesel fuel, heating oil, kerosene, etc. with markers, as for example, as taught in U.S. Pat. No. 5,205,840.

A dye is defined herein as a material lending visible color when dissolved in the dyed fuel. Examples of dyes which have been used for dyeing organic liquids are Color Index Solvent Red #24, Solvent Red #19, Solvent Yellow #14, Solvent Blue #36, and Solvent Green #3.

A marker is defined herein as a substance which can be dissolved in a liquid to be identified, then subsequently detected by performing a simple chemical or physical test on the tagged liquid. Markers that have been proposed, or are in use, include furfural, quinizarin, diphenylamine and radioactive materials. (Radioactive materials have not been accepted in Western countries because of special equipment and precautionary measures associated with their handling.)

Dyes and markers are needed to clearly distinguish chemically or physically similar liquids. As one example, fuels are dyed or tagged to provide visually distinctive brand and grade denominations for commercial and safety reasons. As another example, some lightly taxed fuels are dyed or tagged to distinguish them from similar materials subject to higher taxes. Furthermore, certain fuels are dyed or tagged to deter fraudulent adulteration of premium grade fuels with lower grade fuels, such as by blending kerosene, stove oil, or diesel fuel into regular grade gasoline or blending regular grade gasoline into premium grade gasoline. Identification of particular batches of bulk liquids for protection against theft is another valuable function of markers and dyes, particularly for identifying fuels owned by large government, military or commercial consumers. Finally, marketers of brand name fuels dye or tag their fuels to detect substitution of others fuels in their distribution system.

Dyes alone are not always adequate to securely and reliably identify liquids. Many dyes are easily removed by unauthorized persons. Furthermore, dyes can be obscured by other natural or added substances (particularly dyes present at low concentrations in a mixture of fuels). Because dyes alone have these shortcomings, a combination of a dye and a marker often is used to tag an organic liquid.

Above-referenced U.S. Pat. No. 5,156,653 recites important characteristics of certain desirable markers for petroleum include:

1. are entirely foreign to the liquids;
2. can be supplied as highly concentrated solutions in petroleum-compatible solvents;
3. are easily detected by a simple field test;
4. are not obscured by unstable natural components of the liquids;
5. are stable over the anticipated storage life of the tagged liquid (usually three to six months); and
6. have identities which can be confirmed by laboratory methods.

The dyes of the present invention fulfil requirements of 1–6 above. The markers of the present invention are "silent" in that at the levels at which they are used, they provide substantially no color to the petroleum fuel, but undergo a reaction during a detection procedure. The silent nature of the markers of the present invention make them particularly suitable as markers in non-dyed petroleum fuels, but they are suitable in dyed petroleum fuels, as well, where the markers do not alter the color imparted by the dyes. The silent nature of the markers of the present invention also is advantageous in that they cannot be detected without an appropriate reactive extraction system, making misuse or dilution of a petroleum fuel mixed with a marker of the present invention more difficult.

A suitable petroleum marker that is to be extracted by a petroleum-immiscible solution must meet somewhat demanding solubility requirements. In the final product, the marker is only present in the petroleum fuel in parts-per-million quantities, but the marker is desirably provided to the petroleum in concentrated form, either in a petroleum fuel or in a petroleum-miscible solvent. On the other hand, a small amount of extractant should remove substantially all of the marker from the specimen of petroleum fuel being tested.

The markers of the present invention are detectable by extraction from the petroleum fuel with a dilute acidic solution, e.g., a 10% HCl or formic acid solution. It is desirable that acid-extractable markers be available, particularly markers which develop a color sufficiently strong to be clearly differentiated from any background color which might develop from acid reaction with petroleum impurities or develop a color which is sufficiently different from any such background color.

Acid-extractable markers in use today suffer significantly from the fact that they require the use of concentrated mineral acids to extract, resulting in very significant interference from extracted background color.

Having acid-extractable markers increases the variety of materials with which petroleum might be marked. As most present day markers are base-extractable, someone intent on mislabeling petroleum fuel might first check for marker by extraction with base, thereby missing an acid-extractable marker. Also, acid-extractable markers may provide for a double marking system, including both the acid-extractable marker and a base-extractable marker. Likewise, the impermissible mixing of two petroleum fuels each tagged with base-extractable markers might be missed, particularly if the developed marker colors is similar; whereas, impermissible mixing a petroleum fuel tagged with an acid-extractcable marker and a petroleum fuel tagged with a base-extractable marker can be detected by subsequent extractions with acid and base.

Markers of the present invention are also advantageous in that they provide relatively quantitative determinations. Most markers are adequate for detection of their presence in petroleum fuel; however, many available markers, especially acid-extractable markers, do not provide a good quantitative measurement of their levels in liquid petroleum fuels. Quantitative determinations are particularly important in cases where dilution is suspected, e.g., dilution of a higher-taxed fuel with a lower-taxed fuel.

SUMMARY OF THE INVENTION

In accordance with the present invention, liquid petroleum fuels are tagged with a marker of the formula:

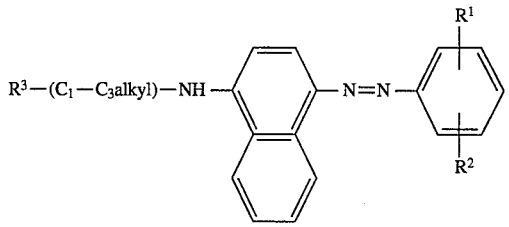

where $R^1$ and $R^2$ are selected from H, methyl, ethyl, methoxy, halogen, cyano and nitro and $R^3$ is selected from methyl, methoxy, methoxyethoxy and morpholino.

Markers at levels of about 0.25 parts per million (ppm) or above (usually at least about 1 ppm) are added to liquid petroleum fuels. The markers may be detected in the petroleum fuels by extraction with an acidic aqueous solution. This acidic aqueous solution not only extracts the marker from the liquid petroleum fuel, but causes the marker to react, producing a clearly defined color that identifies the petroleum fuel as to source, permitted use, etc.

The present invention further provides novel compounds particularly suitable as markers for petroleum fuels.

DETAILED DESCRIPTION OF CERTAIN PREFERRED EMBODIMENTS

Markers of the present invention are conveniently synthesized by azo coupling of an appropriately substituted aniline to an alpha-naphthylamine.

Compounds of the above general formula are generally colorless or have a pale yellow color which at the end use levels, e.g., 0.25–100 ppm. On the other hand, in acidic aqueous solution, the resulting amine salt is a rich color. $R^1$, $R^2$ and $R^3$ may be varied to achieve different development colors and to adjust solubility. Preferably, the compounds are soluble to at least 10% in a high boiling aromatic solvent. (By high boiling is meant having a boiling point of about 200° C. or above.) Some compounds in accordance with the invention have solubilities in high boiling aromatic solvent of 40 to 60%, enabling a very concentrated marker solution to be provided.

The final amount of marker in the tagged liquid petroleum fuel will depend upon a variety of factors. It is generally necessary to have at least about 0.25 ppm in the finally tagged liquid petroleum fuel. Usually, however, a somewhat greater amount will be provided, e.g., 5–40 ppm, enabling the marker to be detected, should the tagged petroleum fuel be diluted with non-tagged petroleum fuel. It is generally desirable to provide an amount of marker that might be detected in a simple field test. Of course, where sophisticated testing equipment is available, it may be possible to use even less marker.

Extraction of the marker from the tagged petroleum fuel may conveniently be carried out with a dilute, e g , 10–30%, aqueous solution of an acid, such as HCl, formic acid, and phosporic acid. The extraction solution may also includes a water-miscible, petroleum-immiscible organic solvent, such as methanol. The acid forms a salt with the secondary amine group, resulting in development of the color and also changing the solubility of the marker so that it is substantially less soluble in petroleum and substantially more soluble in aqueous medium.

Typically the volume ratio of extraction mixture to liquid petroleum is between about 1:1 and about 1:40. If marker is present in the petroleum fuel, it will be extracted by the aqueous layer and colored by reaction with the extraction mixture. Colorimetric equipment may be used to quantify the amount of marker in the aqueous layer. As long as similar conditions, e.g., volume-to-volume, ratios are used for similar liquid petroleum fuels, the color that is produced is relatively quantitative. The test is not "quantitative" in the strict sense that exact levels of marker can be tested in tagged petroleum. This is due in large part to the nature of petroleum fuels which are mixtures of a wide variety of compounds. Depending upon the particular batch of petroleum fuel, the level of impurities extractable by the extraction solution may vary. However, in tests conducted according to the present invention, it is generally possible to determine marker levels to within about 5%.

One of the advantages of the invention is the simplicity of the qualitative test afforded by the markers and extraction/development solutions. Experience has indicated that inspectors in the field are often adverse to performing all but the most simple tests. The test, as indicated above, is a quick, one-step test. Convenience can be enhanced by providing an inspector a pre-measured amount of extractant solution in an extraction vial and, preferably, means to measure an appropriate amount of petroleum fuel. For a rough estimate of marker level, the inspector might even be provided with a color chart against which to compare the developed color.

The invention will now be described in greater detail by way of specific examples.

EXAMPLE 1

Synthesis of 4-(2-methoxyphenylazo)-1-(3-methoxypropylamino)naphthalene.

To a three liter flask was charged 200 grams of ice and 1.25 moles of hydrochloric acid. 63.6 grams of o-anisidine was added. At a temperature of 0°–3° C. was added 35 gm of sodium nitrite as a 40% solution. Once the o-anisidine was fully diazotized, 100 gm. of methoxypropyl alpha naphthylamine and 100 gm of xylene were added. The pH was then raised to between 3.5 and 4.0 with a mineral alkaline buffering agent. The coupling temperature was maintained at between 8°–12° C. while the mixture was stirred for 4 hours until a negative coupling test was achieved. The reaction was heated to 70° C. An organic layer was separated from an aqueous phase. Xylene was stripped under vacuum. The non-volatile tarry substance was dissolved in an aromatic high flash solvent which is 50% product/50% viscosity depressant, which solution is stable at −20° C. indefinitely.

A solution 50 ppm of the marker in kerosene provided, if any color, a pale yellow. Extraction with 10% HCl produced a magenta extract. This was detectable at levels below 5 ppm.

EXAMPLES 2–4

Additional markers were produced as per example 1 but using 2) 47 gm. aniline, 3) 69 gm of p-cresidine, and 4) 1125 gm. amino azo toluene. These markers, when extracted with acid, develop red, blue, and red respectively.

While the invention has been described in terms of certain preferred embodiments, modifications obvious to one with ordinary skill in the art may be made without departing from the scope of the present invention.

Various features of the invention are set forth in the following claims.

What is claimed is:

1. A method of tagging a liquid petroleum fuel and identifying the tagged petroleum fuel, the method comprising adding to said liquid petroleum fuel a detectable level of a marker having the formula:

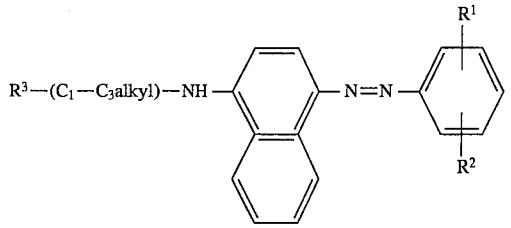

where $R^1$ and $R^2$ are selected from H, methyl, ethyl, methoxy, halogen, cyano and nitro and $R^3$ is selected from methyl, methoxy, methoxyethoxy and morpholino, and extracting said marker from said tagged petroleum fuel with an acidic aqueous medium, thereby developing a color.

2. A method according to claim 1 wherein said marker is added to said petroleum fuel at a level of at least about 5 ppm.

3. A method according to claim 1 wherein said marker is added to said petroleum fuel at a level of at least about 0.25 ppm.

* * * * *